United States Patent [19]

Haller et al.

[11] 4,423,758

[45] Jan. 3, 1984

[54] DISC TYPE WOOD CHIPPER KNIFE HAVING POSITION ADJUSTING SERRATIONS

[75] Inventors: Jack R. Haller; Dino M. Demopoulos, both of Wausau, Wis.

[73] Assignee: Murray Machinery, Inc., Wausau, Wis.

[21] Appl. No.: 352,246

[22] Filed: Feb. 25, 1982

[51] Int. Cl.[3] ..... B27C 7/10; B02C 18/18

[52] U.S. Cl. ..... 144/176; 144/241; 241/92; 241/292.1

[58] Field of Search ..... 144/162 R, 172, 174, 144/176, 218, 230, 241; 241/92, 296, 292, 298, 292.1; 407/45, 95, 96

[56] References Cited

U.S. PATENT DOCUMENTS

| | | | |
|---|---|---|---|
| 2,037,642 | 4/1936 | Scribner | 144/230 |
| 2,917,091 | 12/1959 | Smith et al. | 144/230 |
| 3,559,705 | 2/1971 | Salzmann, Jr. | 144/162 R |
| 3,854,511 | 12/1974 | Maier | 144/230 |
| 4,047,670 | 9/1977 | Svensson | 144/176 |
| 4,298,044 | 11/1981 | Hansel et al. | 144/176 |
| 4,351,487 | 9/1982 | Haller et al. | 241/92 |

*Primary Examiner*—W. D. Bray

*Attorney, Agent, or Firm*—James E. Nilles

[57] ABSTRACT

A knife assembly for a disc type wood chipper for cutting wood chips from a log, for example, comprises a knife seat and knife clamp between which a multi-section two-edged reversible knife and an associated counter knife are releasably clamped. One surface of the knife has serrations which engage serrations on one surface of the counter knife to ensure proper knife alignment and enable knife position adjustment, at least in one embodiment. The counter knife is also adjustably positionable relative to the knife seat and knife clamp.

8 Claims, 6 Drawing Figures

DISC TYPE WOOD CHIPPER KNIFE HAVING POSITION ADJUSTING SERRATIONS

BACKGROUND OF THE INVENTION

1. Field of Use

This invention relates generally to material chopping devices, such as disc type wood chippers. In particular, it relates to a knife assembly for use therein in which the knife is adjustably positionable relative to the knife holding means.

2. Description of the Prior Art

U.S. patent application Ser. No. 187,164 entitled KNIFE ASSEMBLY FOR CHOPPING APPARATUS filed Sept. 15, 1980 by Jack R. Haller and William M. Haselton and assigned to the same assignee as the present application, now U.S. Pat. No. 4,351,487, discloses a knife assembly for use in a chopping apparatus, such as a wood chipper, of the type having a rotatable disc and an opening therethrough to permit passage of the chopped material through and away from the disc. The assembly comprises a pair of knife holding means including a knife seat and a knife clamp or cover, for engaging a reversible knife with two cutting edges. Means are provided to ensure proper alignment of the knife and its knife holding means. Thus, one of the knife holding means has a flat knife engaging surface for cooperatively engaging a complementary flat surface of the knife. The other knife holding means has either an arcuate protrusion for cooperatively engaging an arcuate groove in the knife, or an arcuate groove cooperating with the groove in the knife to define a space for accommodating a rod which prevents relative blade movement. However, this knife assembly does not permit the position of the knife edge to be adjusted or changed relative to the knife holding means. Such change in position may be necessary after a knife has been sharpened a sufficient number of times to significantly change its dimensions. Or, such change in position might be desirable to alter the size of the chips being cut or to accommodate the nature of the material being cut. Minor adjustments are also desirable to accurately align all adjoining knife edges in a true vertical plane of rotation for closer running clearances between the disc knives and the stationary anvil or base knives, thus producing a product of more uniform size with more cleanly sheared surfaces.

U.S. Pat. No. 3,559,705 issued Feb. 2, 1971 to Louis Salzmann, Jr. for CHIPPER KNIFE AND KNIFE MOUNTING FOR DRUM TYPE WOOD CHIPPER discloses a reversible symmetrical knife for a drum type wood chipper. Such knife is extremely short in length, as compared to the knives used in disc type chippers, and the cutting edge thereof moves in a circular plane, as compared to the flat plane in which the knife cutting edge moves in a disc type chipper. Furthermore, in the structure shown in U.S. Pat. No. 3,559,705 a holder is secured to the inner surface of a drum wall by means of a screw. The head of the holder has a serrated surface which engages the serrated surface of the knife and the knife is secured to the holder by means of a clamp or block which is secured to the head by means of a screw. In the aforesaid structure, forces acting on the knife as the latter cuts are ultimately transferred as shear forces to the screw through the block and to the other screw through the holder. Although there is a direct transfer of force from the knife to the block and a transfer of force from the knife to the holder through the serrations, there is no direct face-to-face transfer of force from the block to the holder or from the holder to the drum wall. Such an arrangement is tolerable in a drum type chipper wherein the knives are very short but is not acceptable strengthwise in a disc type chipper wherein the knives are quite long and encounter greater forces for a longer time interval during chipping.

SUMMARY OF THE INVENTION

Apparatus in accordance with the invention for chopping material, such as logs, comprises a rotatable disc and at least one radially disposed opening extending through the disc and a knife assembly comprising first knife holding means attached to the disc and adjacent the opening and second knife holding means mounted on the first knife holding means. The first knife holding means comprises a knife seat secured to the disc by screws and a counter knife secured to the knife seat by other screws. The counter knife has a first knife-engaging portion including protruding serrations thereon. The second knife holding means has a second knife-engaging portion including a flat knife-engaging surface. A reversible knife having two cutting edges is mounted between said first and second knife holding means. The knife has a complementary flat surface for cooperatively engaging the flat knife-engaging surface of the second knife holding means. The knife has indented serrations for cooperatively engaging the protruding serrations. Clamping engagement means are provided for clampingly engaging the knife between the counter knife of the first knife holding means and the second knife holding means. The clamping engagement means comprises studs with two ends. Each stud has one of the ends fixed to the second knife holding means and the other of said ends is threaded. The threaded end is threadably engaged to a nut abutting the rotatable disc, whereby rotation of the nut causes axial movement of the stud therealong and permits relative movement between the first knife holding means and the second knife holding means.

The counter knife is secured to said knife seat by securement means, such as the aforesaid other screws, which enables the counter knife to be adjustably positioned relative to the knife seat.

In one embodiment the knife has the same number of indented serrations as there are protruding serrations on the counter knife whereby the knife and the counter knife can assume only one position relative to each other and there is no possibility of knife position error when a knife is installed.

In another embodiment the knife has a larger number of indented serrations when there are protruding serrations on the counter knife whereby the knife and the counter knife can assume a plurality of positions relative to each other to further enhance knife position adjustability.

The serrations disclosed are triangular in cross-section but could take some other form. Knife position gauge means are provided on the inner most end of each knife seat.

A disc type chipper in accordance with the invention offers several advantages over the prior art. For example, the configuration and arrangement of the components including the disc, the knife seat, the knife cover, the counter knife and the knife, as well as the cap screws and studs, provides a substantially stronger arrangement than in prior art chippers and provides for transfer of forces between the surfaces of components rather than merely through the studs and cap screws. Furthermore, the knife, when interlockingly engaged with the counter knife, is adjustably positionable in response to positioning of the counter knife on the knife seat, the positioning means therefore including cap screws and shims. In one embodiment, the arrangement of serrations on the knife and counter knife is such that the knife can only assume one position with respect to the counter knife and this ensures that the knife is always in proper position on the disc, assuming, of course, that the counter knife is properly positioned. In another embodiment, the arrangement of serrations on the counter knife and knife is such that the knife can assume any one of several positions relative to the counter knife and this arrangement provides for an even range of adjustments of knife positioning. The combination of movement of the knife on the serrations and the fine adjustment of the counter knife by use of shims provides an infinitely adjustable knife projection for very accurate alignment of all adjoining knife edges and subsequent closer running clearance adjustment of the disc knives and the stationary anvils or base knives. In addition, the counter knife serves as the point of maximum wear and, being a relatively small piece, is substantially cheaper to replace when worn than is the larger knife seat in some prior art apparatus. Other objects and advantages of the invention will hereinafter appear.

DESCRIPTION OF A PREFERRED EMBODIMENT

Figure 1:
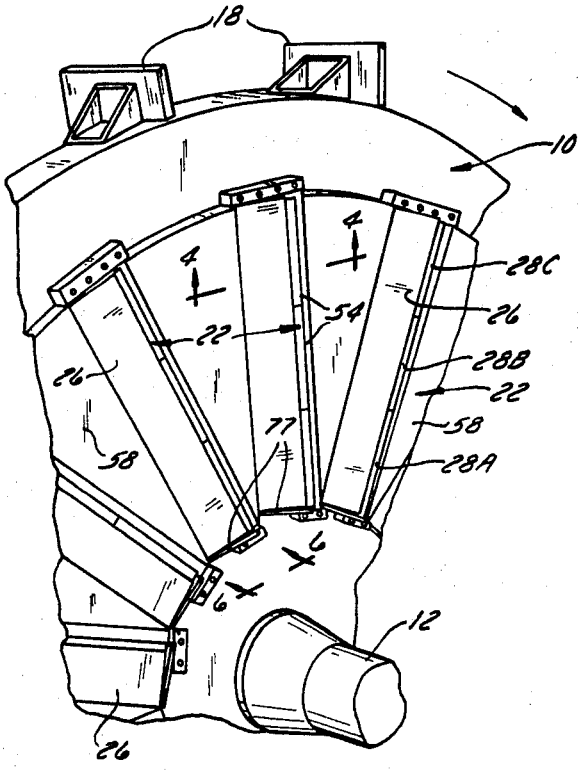
FIG. 1 is a perspective view of a part of a rotatable chopping disc of a disc type wood chipper within which the knife assembly comprising the invention is mounted.
Figure 2:
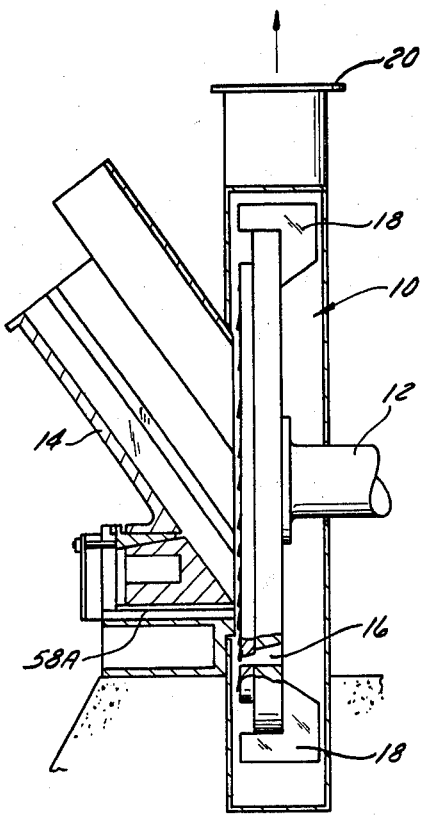
FIG. 2 is a vertical, sectional view of the chopping apparatus embodying the present invention.

The knife assembly 22 described herein is typically for use in a chopping disc of a disc type wood or log chipper, as shown in FIGS. 1 and 2. The disc 10 is rotatable by a shaft 12 powered by power means (not shown). The materials to be chopped, such as logs, are fed to the disc 10 through a spout 14 angularly disposed to the axis of the disc, as defined by the shaft 12. After the wood is chopped into small pieces or chips, those chips pass through radially disposed openings 16, the details of which will be explained later, and are then swept by a plurality of paddles 18 attached to the radial ends of the disc 10 through a spout or discharge opening 20 for transfer to a remote location.

As an alternate, the chips can drop through an opening in the bottom of the chipper enclosure on to a conveyor beneath the chipper.

The knife assembly 22 includes an elongated knife seat 24 on which is mounted, by means of cap screws 19, a counter knife 21 which constitute a first knife holding means. The assembly 22 also includes an elongated knife cover or clamp 26 which constitutes a second knife holding means, a plurality of disc knives 28A, 28B, 28C which constitute reversible knives, and means 30 for clampingly engaging the knives 28A, 28B, 28C between the first knife holding means 21, 24 and the second knife holding means 26. The knife seat 24 is attached to the disc 10 and rotates therewith, and is also adjacent the radial opening 16 by which the chopped material passes through and away from the disc 10 after being chopped by the knife assembly. The second knife holding means or clamp 26 is mounted on the knife seat 24, as may be seen in FIG. 4, where a surface 32 at the upper end of the knife cover 26 rests against an elongated support 30 of knife seat 24.

Figure 4:
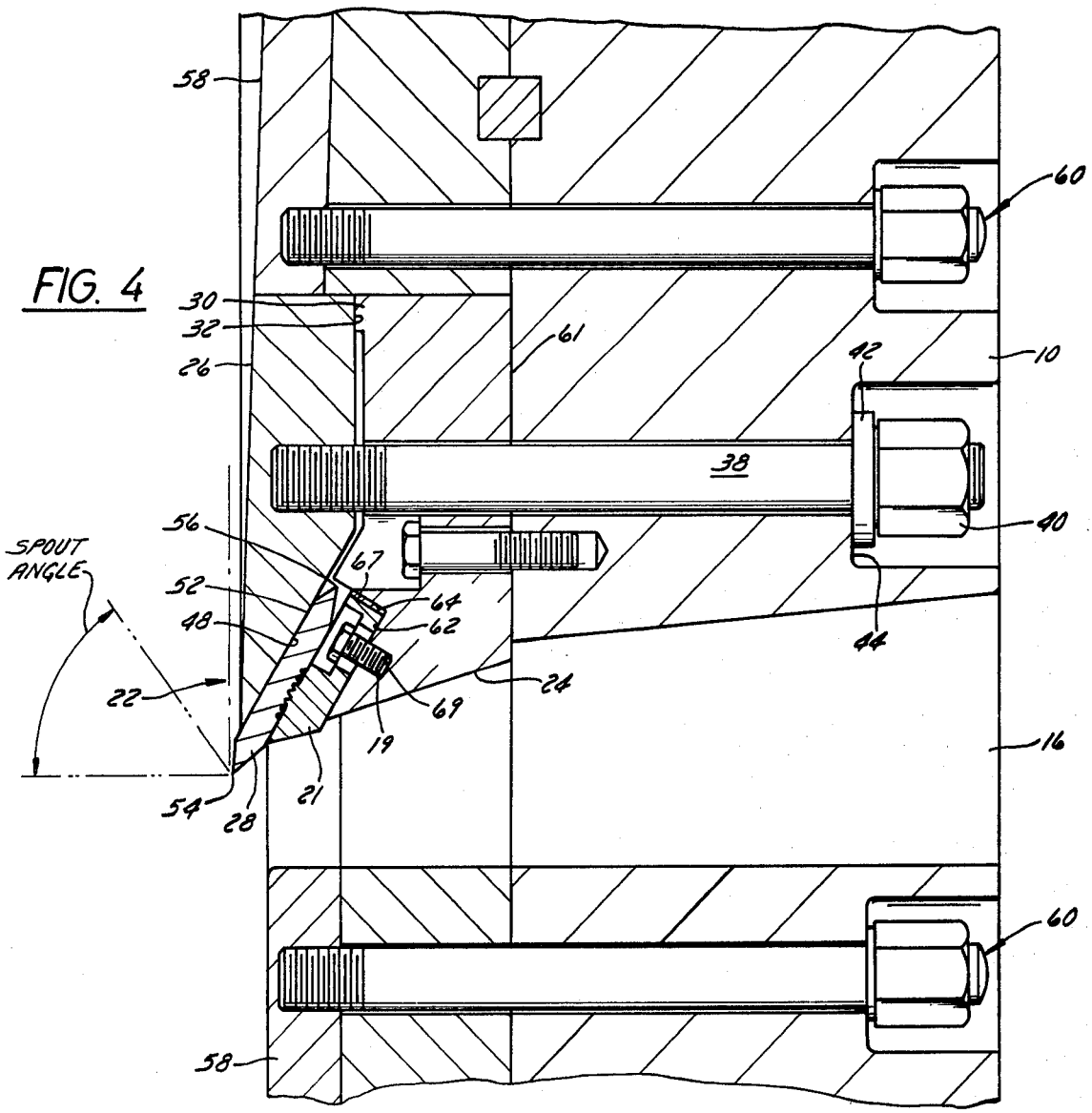
FIG. 4 is a cross-sectional view of a knife and its associated counter knife engaged between the two holding means taken on line 4—4 of FIG. 1.

The support 30 for clampingly engaging the knife 28 between the knife seat 24 and counter knife 21 and the knife holding means 26 includes threaded studs 38, each having one end threadably engaged in the second knife holding means 26, which permits easy replacement of second knife holding means 26 when it is worn or damaged. The other end of stud 38 is threaded, and is threadably engaged to a nut 40, which abuts the disc 10 through a special washer 42. As shown in FIG. 4, the surface 32 of second knife holding means 26 is tightly abutting the adjacent support 30 of first knife holding means 24, such that no rightward movement of second knife holding means 26, with respect to first knife holding means 24 is possible, and the knife 28 and counter knife 21 are firmly engaged therebetween. Stud 38, which passes through the knife holding means 24 and into 26 and also extends through disc 10, permits relative clamping movement of knife holding means 24 and 26. Assuming right-hand threads, counterclockwise rotation of nut 40 about the threaded end to which it is engaged results in space between nut 40 and washer 42 or between washer 42 and the disc face 44 abutting that washer. This space permits leftward movement of stud 38, which in turn permits leftward movement of second knife holding means 26 relative to first knife holding means 24. Knife 28 and counter knife 21 will then no longer be tightly engaged between means 24 and 26, and thus may be readily removed to facilitate adjustment or reversal or replacement of the knife.

The counter knife 21 has a first knife-engaging portion including a plurality of protruding serrations thereon. The knife holding means or cover 26 has a second knife-engaging portion including a flat knife-engaging surface 48. In the two embodiments described herein, the counter knife 21 has the protruding serrations and the second knife holding means 26 has the flat knife-engaging surface.

Each elongated knife seat insert 24 has attached thereto the counter knife 21 with which knife 28 is associated, which knife may be of one-piece of multiple-piece construction. A three-piece knife, each piece designated 28A, 28B or 28C being identical, is shown mounted beneath the elongated knife cover 26 of FIG. 1. Knife 28 chops material as it rotates with disc 10 by cooperative cutting action with the base knives or anvil 58A. Each knife 28 has two sides, one side 51 formed so as to include indented serrations 50 which accept the protruding serrations 46 and the other side 52 formed flat to engage the flat knife-engaging surface 48 of clamp 26.

In one of the two embodiments described herein, particularly that shown in FIG. 4, the serrated protrusions 46 integrally formed on the counter knife 21 of the first knife holding means 24 and the serrations 50 on knife 28 are triangular in cross-section. In this embodiment, the number of serrations 46 equals the number of serrations 50, nine of each being shown. This embodiment illustrates the ability of the knife 28, when mounted as described, to align itself on the counter knife 21 of the second knife holding means 26 and provide good contact thereagainst.

Figure 3:
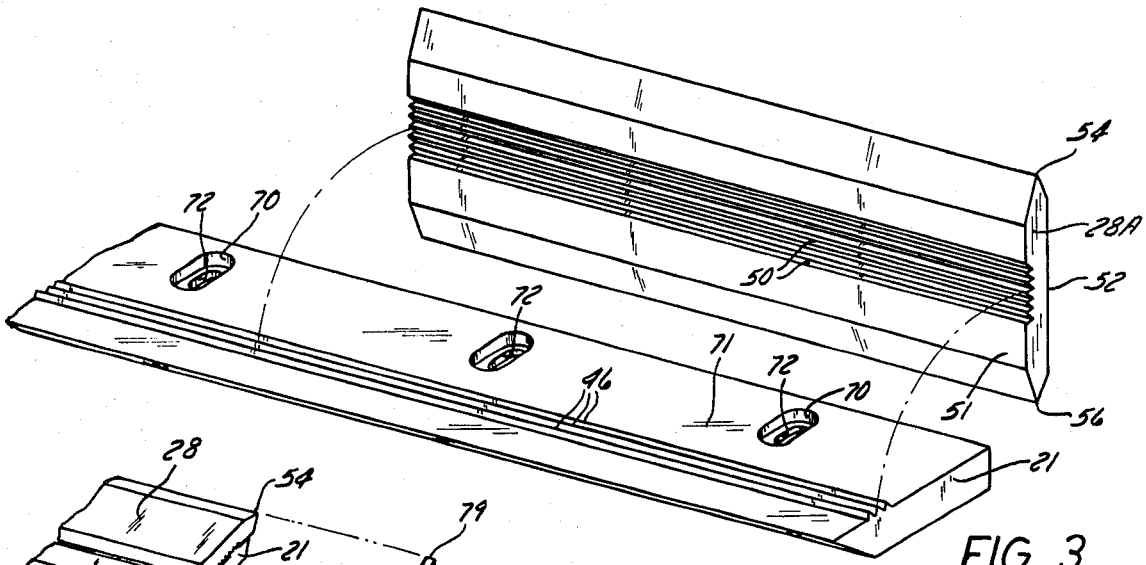
FIG. 3 is an exploded perspective view of a knife and its associated counter knife.
Figure 5:
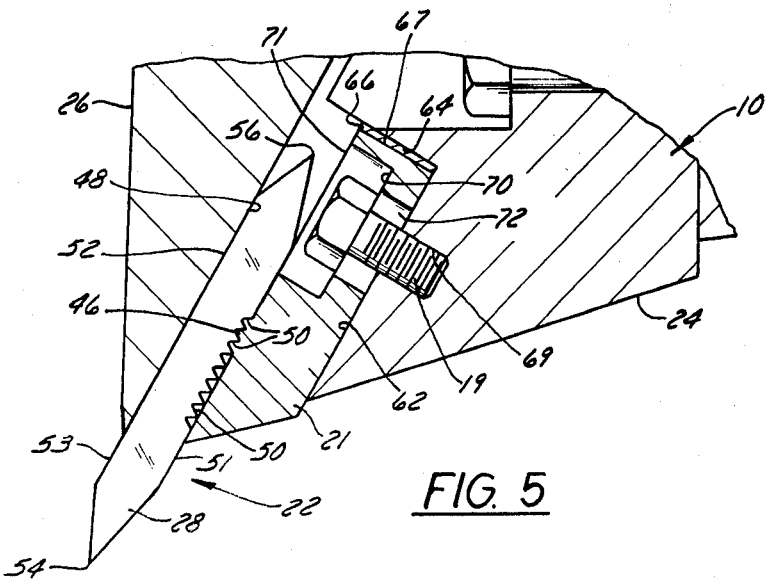
FIG. 5 is a cross-sectional view of the apparatus shown in FIG. 4, on an enlarged scale, but comprising an alternate embodiment of the knife assembly shown in FIG. 3.

In the second of the two embodiments described herein, particularly that shown in FIGS. 3 and 5, there is a lesser number of the protruding serrations 46 than the serrations 50 on knife 28. Thus, knife 28 can be placed in any one of several positions relative to counter knife 21. In both embodiments, the mating serrations 46 and 50 act as thrust elements.

In both the embodiments, the second side of the knife 28 comprises the complementary flat surface 52, which engages the flat knife-engaging surface 48 of second knife holding means 26. This flat surface 52, as explained hereinabove, transmits less stress per unit area to the flat knife-engaging surface 48 than any other configuration and thus permits the second knife holding means 26 to be constructed of a less expensive material than would be possible with another configuration.

The knife has two cutting edges 54 and 56. When edge 54 wears out, the knife holding means 24 and 26 are separated as described above, and the knife is rotated 180° about an axis normal to the surface 71 of counter knife 21 so as to present edge 56 as the cutting edge. When both edges 54 and 56 are dull, the knife is removed for sharpening and replaced on the counter knife 21. During replacement, the knife 28 may be repositioned on the counter knife 21 or the latter may be repositioned on the knife seat 24 or both may be repositioned.

The apparatus is also provided with a plurality of replaceable disc wear plates 58, secured to the disc 10 with stud and nut means 60.

As FIGS. 4 and 5 show, the knife seat 24 comprises a large base surface 61 which bears against disc 10 and also comprises an outwardly facing groove which receives the counter knife 21 and is defined by the two surfaces 62 and 64 which meet at a right angle. One or more shims or groups 66 are disposed between the rear edge surface 67 of counter knife 21 and the surface 64 of knife seat 24. The shim thickness determines the rearwardmost position of knife seat 24. Knife seat 24 is provided with threaded holes 69 for receiving the threaded ends of the cap screws 19 which secure the counter knife 21 to the knife seat 24. The heads of screws 19 are received in countersunk recesses 70 in the surface 71 of counter knife 21 and the shank of screws 19 extends through elongated slots 72 in counter knife 21. Slots 72 enables the counter knife 21 to be positioned at different distances from surface 64 of knife seat 24.

Figure 6:
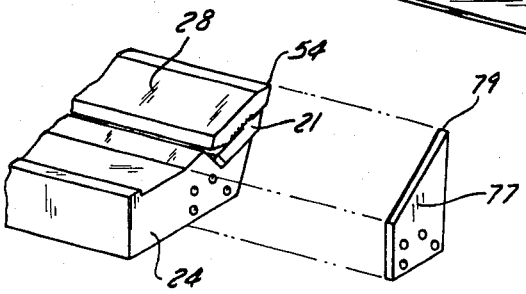
FIG. 6 is a perspective view of a gauge.

Knife position gauge means are provided to ensure that the knife 28 is located in correct position on the disc 10 relative to all other components. As is apparent knife 28 can be held in a fixed position relative to counter knife 21 because of the interengaging serrations 46 and 50. In the embodiment of FIG. 5, only one fixed position is possible, whereas in the embodiment of FIG. 4 any one of several fixed positions is possible. In both embodiments, however, counter knife 21 can be placed in many positions relative to knife seat 24 because of the screw-receiving slot 72 in counter knife 21. Accordingly, in FIG. 4 knife 28 can assume several possible positions, only one of which is correct relative to knife seat 24, knife position gauge means are provided to ensure placement of the knife in that position. As FIGS. 1 and 6 show, such means comprise a plate 77 which is secured as by a plurality of cap screws to the innermost end of knife seat 24. Plate 77 is trapezoidal in form and its outer point 79 defines the locus of knife edge 54. Provision of such gauge eliminates the need to measure blade position in the embodiment of FIG. 4. It is to be understood that the knife position gauge means could be mounted on a component other than the knife seat and could take a form other than shown.

I claim:

1. Apparatus for chopping material comprising: a rotatable disc means comprising at least one radially disposed opening extending through said disc means and an elongated recess adjacent said opening, and a knife assembly for said disc means comprising:

an elongated knife seat disposed in said recess and secured to said disc means, said knife seat having an elongated groove therein;

a counter knife disposed in said groove and secured to said knife seat, said counter knife having a knife-engaging surface including protruding serrations thereon;

means for rigidly securing said counter knife to said knife seat but which enable said counter knife to be adjustably positioned in said groove relative to said knife seat;

a knife clamp having a flat knife engaging surface;

a reversible knife having two cutting edges and mounted between said counter knife and said knife clamp, said knife having a flat surface for cooperatively engaging said flat knife engaging surface of said knife clamp, said knife further having an opposite surface including indented serrations for cooperatively engaging said protruding serrations on said counter knife;

and means for releasably connecting said knife clamp to said disc means for clampingly engaging said knife between said counter knife and said knife clamp.

2. The apparatus set forth in claim 1 wherein said disc means comprises a disc having a stud-receiving hole therethrough, wherein said knife seat has a stud-receiving hole therethrough, and wherein said means for releasably connecting said knife clamp to said disc means comprises a stud which extends through said stud-receiving holes, one end of said stud fixed to said knife clamp and the other end of said stud being threaded, said threaded end being threadably engaged to a nut abutting said disc means, whereby rotation of said nut causes axial movement of said stud therealong and permits relative movement between said knife clamp and said knife seat.

3. Apparatus according to claim 2 wherein said knife has the same number of indented serrations as there are protruding serrations on said counter knife whereby said knife and said counter knife can assume only one position relative to each other.

4. Apparatus according to claim 2 wherein said knife has a larger number of indented serrations than there are protruding serrations on said counter knife whereby said knife and said counter knife can assume a plurality of positions relative to each other.

5. The apparatus set forth in claim 3 or 4 further characterized in that said serrations are triangular in cross-section.

6. Apparatus according to claim 1 including gauge means to position said knife relative to said disc.

7. Disc-type apparatus for chopping material comprising:

a disc having spaced apart surfaces and rotatable about an axis perpendicular to said surfaces, said disc having at least one radially disposed elongated opening extending therethrough between said surfaces;

a disc plate disposed adjacent a surface of said disc and having a radially disposed elongated opening extending through said disc plate in registry with said opening in said disc but of greater width so as to define an elongated recess wherein a portion of said surface of said disc is exposed;

a wear plate disposed adjacent said disc plate and having a radially disposed elongated opening extending through said wear plate in registry with said opening in said disc plate;

means for securing said disc, said disc plate and said wear plate together;

an elongated knife seat disposed in said recess and bearing against the exposed portion of said surface of said disc and against a side of said opening in said disc plate, said knife seat comprising an outer surface having a projection thereon and an outwardly facing angularly disposed elongated groove;

means for rigidly securing said knife seat to said disc and including a screw extending through a hole in said knife seat and into a threaded hole in said disc;

an elongated counter knife disposed in said groove and having a knife-engaging surface with a plurality of protruding serrations extending therealong, said counter knife further comprising at least one elongaged screw-receiving slot extending therethrough, said slot having a countersunk recess extending inwardly from said knife-engaging surface;

a cap screw in said slot and engaged in a threaded hole in said knife seat for rigidly but adjustably securing said counter knife to said knife seat, each cap screw having its head disposed in said countersunk recess associated with said slot;

shim means disposed between said counter knife and the end of said groove for determining the rearwardmost position of said counter knife relative to said knife seat;

a knife clamp disposed adjacent and bearing against a portion of said knife seat and having a threaded hole therein, said knife clamp comprising a flat knife engaging surface;

a knife having two cutting edges, a flat outer surface, and an inner surface having inwardly extending serrations thereon, said knife being disposed between said knife engaging surface of said counter knife and said flat knife engaging surface of said knife clamp, said serrations on said knife engaged with said serrations on said counter knife; and an elongated stud threaded at opposite ends and extending through a hole in said disc, through a hole in said knife seat and into said threaded hole in said knife clamp, said stud having a nut at its other end for securing said knife clamp against said knife seat and for clamping said knife between said knife clamp and said counter knife.

8. Apparatus according to claim 7 wherein said knife comprising a plurality of knife pieces arranged end-to-end.

* * * * *